US008596908B2

(12) United States Patent
Rosinbaum

(10) Patent No.: US 8,596,908 B2
(45) Date of Patent: Dec. 3, 2013

(54) APPARATUS AND METHOD OF USE OF A DRAINAGE MEMBER

(76) Inventor: Terry Rosinbaum, Hunt, TX (US)

( * ) Notice: Subject to any disclaimer, the term of this patent is extended or adjusted under 35 U.S.C. 154(b) by 135 days.

(21) Appl. No.: 12/617,687

(22) Filed: Nov. 12, 2009

(65) Prior Publication Data

US 2010/0119305 A1 May 13, 2010

Related U.S. Application Data

(60) Provisional application No. 61/113,626, filed on Nov. 12, 2008.

(51) Int. Cl.
*E02B 11/00* (2006.01)

(52) U.S. Cl.
USPC ..... 405/43; 405/36; 405/45

(58) Field of Classification Search
USPC ..... 405/39, 40, 43, 45, 51
See application file for complete search history.

(56) References Cited

U.S. PATENT DOCUMENTS

| | | | | |
|---|---|---|---|---|
| 3,699,684 | A | 10/1972 | Sixt | |
| 4,134,268 | A | 1/1979 | Elmore | |
| 4,567,795 | A | 2/1986 | Pool | |
| 4,589,798 | A | 5/1986 | Milly | |
| 4,650,367 | A | 3/1987 | Dietzler | |
| 5,129,757 | A | 7/1992 | Johnson | |
| 5,145,015 | A | 9/1992 | Thompson | |
| 5,836,716 | A | 11/1998 | Johnson et al. | |
| 6,561,732 | B1 * | 5/2003 | Bloomfield et al. | 405/43 |
| 6,612,780 | B2 | 9/2003 | Dahowski et al. | |
| 6,702,517 | B2 | 3/2004 | Goddard | |
| 6,749,367 | B1 | 6/2004 | Terry, III | |
| 6,821,424 | B1 * | 11/2004 | Branz | 210/605 |
| 2002/0172557 | A1 | 11/2002 | Chen | |
| 2004/0005192 | A1 * | 1/2004 | Chapek | 405/39 |
| 2007/0166105 | A1 * | 7/2007 | Rzadkowolski | 405/43 |
| 2008/0078585 | A1 | 4/2008 | Melegari | |

* cited by examiner

*Primary Examiner* — Benjamin Fiorello
(74) *Attorney, Agent, or Firm* — Rodney H. Rothwell; Roberts Mlotkowski Safran & Cole, P.C.

(57) ABSTRACT

A method of use comprises providing an inline pipe grate component and at least partially burying the inline pipe grate component. The inline pipe grate component has a longitudinal axis and a plurality of slits oriented substantially perpendicular to the longitudinal axis.

18 Claims, 10 Drawing Sheets

APPARATUS AND METHOD OF USE OF A DRAINAGE MEMBER

CROSS-REFERENCE TO RELATED APPLICATIONS

This application claims the benefit of U.S. provisional application Ser. No. 61/113,626 filed on Nov. 12, 2008, which application is incorporated herein by reference as if reproduced in full below.

STATEMENT REGARDING FEDERALLY SPONSORED RESEARCH OR DEVELOPMENT

Not Applicable.

BACKGROUND

1. Field of the Invention

This invention relates generally to drainage, and more particularly to the use of a pipe containing a plurality of apertures as a gravity fed ground water or surface water drainage conduit.

2. Description of the Related Art

Water often accumulates above the ground and below the ground surface. Water accumulated above the ground may be referred to as standing water. Water accumulated below the ground surface may be referred to as ground water. In some circumstances accumulated water is desirable, while in other circumstances it is desirable to remove accumulated water.

Conduits are often used to collect, transport, and infiltrate water and other liquids. A collection conduit has a plurality of entry ports through which fluid may enter the conduit. A collection conduit may be used to collect standing or ground water. A transport conduit is generally fluid impermeable having only a single fluid entry port and a single fluid exit port. A transport conduit is used primarily to transport or convey fluid from a first location to a second location. An infiltration conduit has a plurality of exit ports through which fluid may exit the conduit. An infiltration conduit may be used to disperse transported fluid.

SUMMARY OF THE INVENTION

A method of installing a drainage member comprises the steps of providing a drainage member, providing a surface, providing a recess in the surface, and positioning the drainage member in the recess. In an exemplary embodiment the drainage member has a first side, a longitudinal axis, and a plurality of apertures in the first side, the apertures being substantially parallel to the longitudinal axis. In an alternative method the drainage member is positioned so that at least a portion of the pipe is at a height equal to that of the surface. In an alternative method the surface is inclined and defines a grade. The drainage member is installed substantially parallel to the grade.

BRIEF DESCRIPTION OF THE DRAWINGS

For a more complete understanding of the present invention, reference is now made to the following Description of Exemplary Embodiments of the Invention, taken in conjunction with the accompanying drawings, in which.

DETAILED DESCRIPTION

Figure 1:
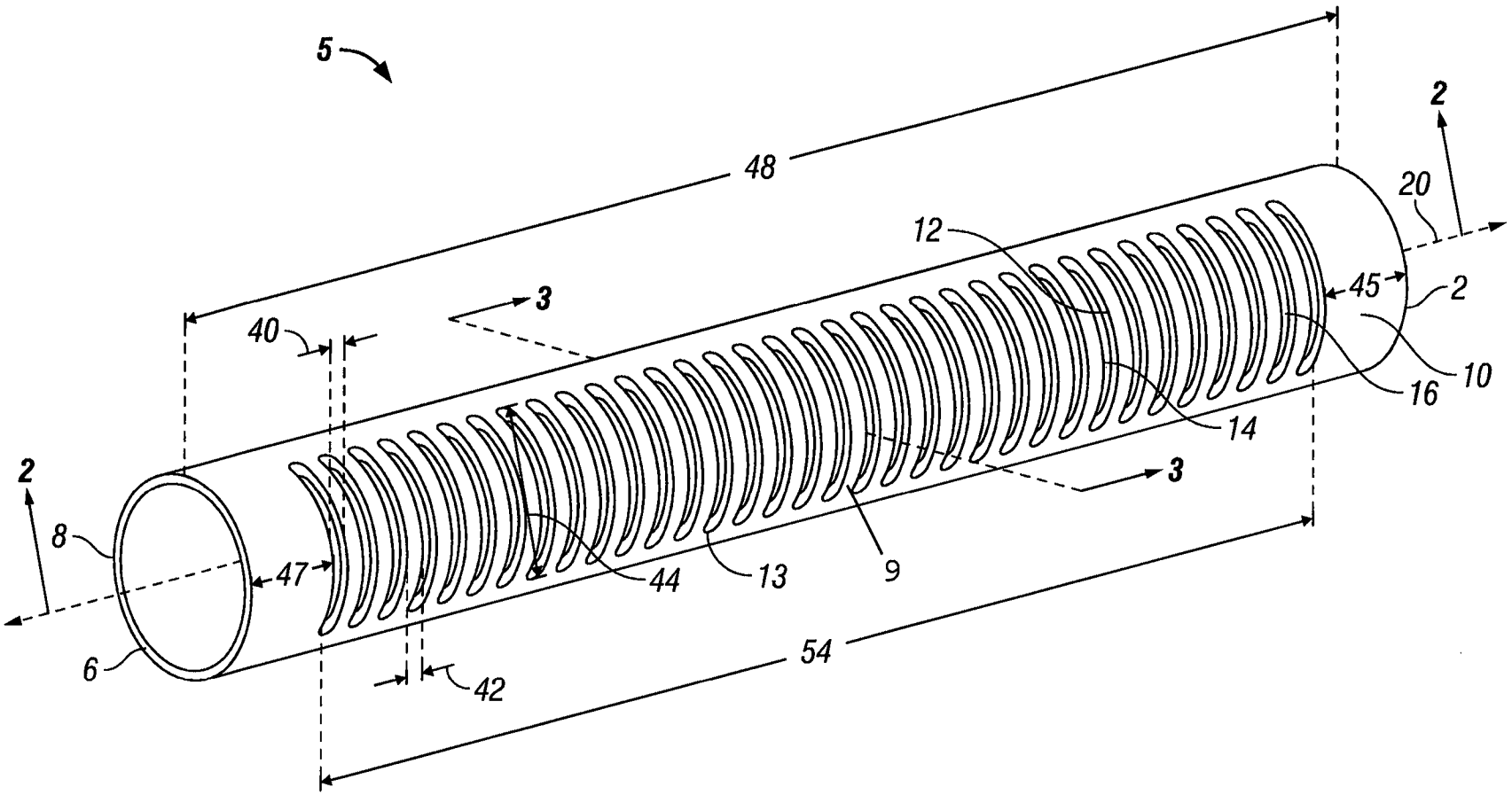
FIG. 1 shows a perspective view of an embodiment of the drainage member
Figure 2:
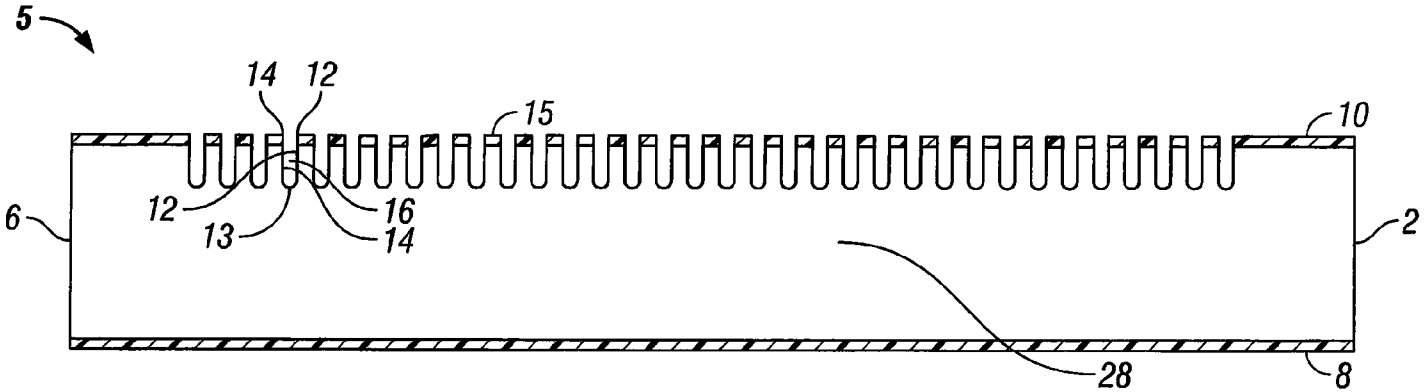
FIG. 2 shows a cross sectional view taken along line 2-2 in FIG. 1.
Figure 3:
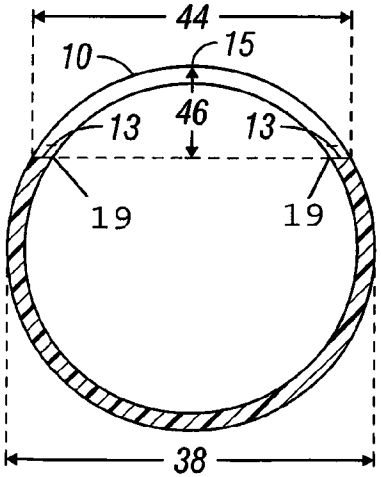
FIG. 3 shows a cross sectional view taken along line 3-3 in FIG. 1.

Embodiments of the invention are best understood by referring to the drawings, like numerals being used for like and corresponding parts of the various drawings. In FIGS. 1-3 there is shown an exemplary embodiment of a drainage member, generally designated 5.

Referring to FIG. 1, an exemplary drainage member 5 is shown. The drainage member 5 is a substantially annular member with a generally hollow interior 28. The drainage member 5 contains a first side 10 and an opposing second side 8. The first side 10 and second side 8 are disposed intermediate the upper end segment 2 and the lower end segment 6 of the drainage member 5. The drainage member 5 has an axis 20 extending longitudinally therethrough.

Referring to FIGS. 1 and 2, the first side 10 of the drainage member 5 has an apertured section 9. The depicted embodiment shows the apertured section 9 to have a plurality of apertures 16 formed therein. It will be understood by those skilled in the art that other forms of apertures may be utilized, including but not limited to, circular perforations, square shaped apertures, a series of longitudinally extending apertures, and the like. A purpose of the apertures 16 is to allow fluid flow therethrough and into the interior of the drainage member 5.

Apertured section 9 has a length 54. The upper end segment 2 and lower end segment 6 of the drainage member 5 do not have apertures 16 formed therein. Second side 8 is water impermeable.

Each aperture 16 has an upper edge 12 and a lower edge 14. The width 40 of an aperture 16 is defined by the distance between the upper edge 12 and the lower edge 14. The distance 42 between successive apertures 16 is defined by the distance between the lower edge 14 of one aperture 16 and the upper edge 12 of an adjacent aperture 16. In an exemplary embodiment, the distance 42 is not greater than three times the width 40. In a further exemplary embodiment, the distance 42 is not greater than one and one-half times the width 40. Alternative ratios of distance 42 to width 40 are utilized and contemplated for use in accordance with this disclosure.

The depicted apertures 16 are slits that are oriented generally perpendicular to axis 20. Generally perpendicular is herein defined to mean that the angle defined by the intersection of upper edge 12 and axis 20, referred to herein as the divergence angle, is not less than about 45°. The divergence angle range being about 45° to about 90°.

Referring to FIG. 3, a cross section taken along line 3-3 in FIG. 1 is shown. Drainage member 5 has an outer diameter 38. The depth 46 of each aperture 16 is defined by the vertical distance between a point 15 within the aperture 16 opening and at least one base portion 13 of the aperture 16. The base portions 13 comprise the beginning and ending points of the aperture 16. The point 15 is intermediate the base portions 13 and is disposed substantially at the highest point between the base portions 13. FIG. 3 depicts the base portions 13 as opposedly positioned points, alternatively, the base portions 13 may not be directly opposedly positioned in that at least one of the base portions 13 may be located closer to point 15 or further away from point 15 than the second base portion 13. A bottom point 22 is defined as the point on the exterior surface of the drainage member 5 opposite point 15.

Referring to FIG. 3, apertures 16 have lateral internal edges 19. The length 44 of an aperture 16 is defined as the distance between the lateral internal edges 19 of aperture 16. In an exemplary embodiment, the length 44 is at least three times the width 40, though other ratios may be utilized. The open flow area of the aperture 16, when defined as a slit as shown in FIGS. 1 and 3, is defined as the length 44 times the width 40. The combined open flow area of apertures 16 within any given axial length, when the aperture 16 is defined as any appropriate aperture shape, is defined as the sum of the open flow area of each aperture 16 provided within the axial length. In an exemplary embodiment, the axial length 54 of the apertured section 9 is less than the sum of four (4) multiplied by diameter 38, and the open flow area provided in apertured section 9 exceeds the cross sectional flow area of drainage member 5.

The length 45 of upper end segment 2 is defined as the distance between the outer edge of upper end 2 and the upper edge 12 of the immediately adjacent aperture 16. In an exemplary embodiment, length 45 is at least three-fourths of the outer diameter 38, though alternative lengths may be utilized. The length 47 of lower end segment 7 is defined as the distance between the outer edge of lower end 6 and the lower edge 14 of the immediately adjacent aperture 16. In an exemplary embodiment, length 47 is at least three-fourths of outer diameter 38, though alternative lengths may be utilized.

Figure 4:
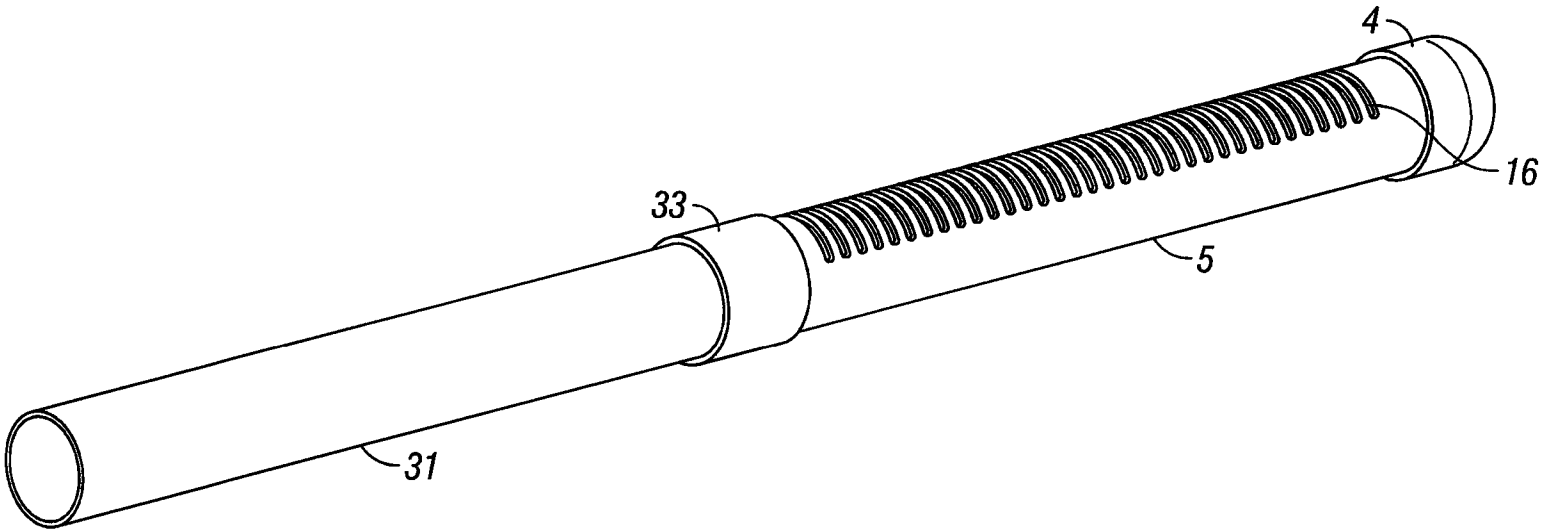
FIG. 4 shows a drainage member connected to a drainage component.

Referring to FIG. 4, an exemplary drainage member 5 is shown connected intermediate a pipe cap 4 and a transfer member 31. In the embodiment shown, transfer member 31 is a length of non-apertured pipe. Pipe cap 4 is attached to upper end segment 3. A pipe fitting 33 is attached between drainage member 5 and transfer member 31. Pipe fitting 33 is attached to lower end segment 7. The attachments may be made using any suitable pipe adhesive, such as an epoxy-based adhesive, or any other suitable attachment as known or discovered in the art. In an alternative embodiment, the attachments may be threaded attachments. In an alternative embodiment pipe cap 4, drainage member 5, and transfer member 31 may all be, or portions thereof may be, integrally connected.

The drainage member 5 may be constructed from plastic piping, including but not limited to PVC piping (polyvinyl chloride), polyethylene, and acrylonitrile butadiene styrene. In alternative embodiments, various pipe materials can be used to create an drainage member 5, including but not limited to: Schedule 40 PVC, Schedule 80 PVC, SDR 26 PVC (Pressure Rated), HDPE (High Density Polyethylene), Ductile or Cast Iron, CMP, Steel, circular or box RC pipes, concrete pipes, and the like.

Figure 5:
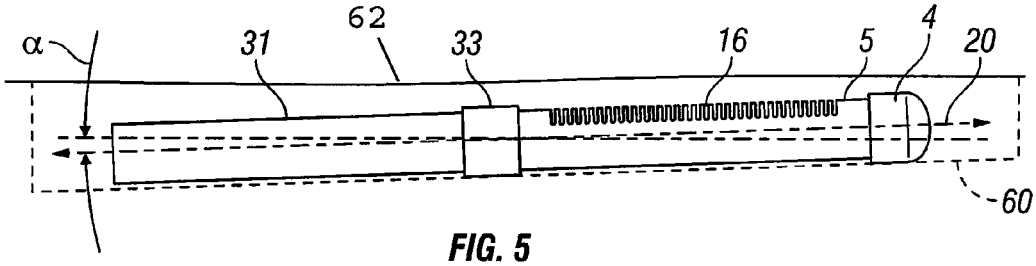
FIG. 5 shows a cross sectional view of a drainage member installed below the ground surface.

Referring to FIG. 5, a method of installation comprises installing a drainage member 5 for use as a gravity-fed, collection conduit.

In an exemplary embodiment the method of installation includes the following steps: providing a drainage member 5, preparing a recess 60, for example a trench, within the ground surface 62, positioning the drainage member 5 in the recess 60, and burying at least a portion of the drainage member 5 in recess 60.

Referring to FIG. 5, positioning the drainage member 5 includes placing the drainage member 5 in the recess 60 with the first side 10 facing substantially upward. Substantially upward is herein defined to mean that the point 15 of first side 10 is vertically higher than the corresponding point 16 on the second side of drainage member 5. Drainage member 5 may be positioned so that axis 20 is inclined with respect to horizontal. The incline is preferably greater between 0 and 5 degrees.

Alternatively, the drainage member 5, may be positioned in the recess 60 with the first side 10 offset from facing substantially upward.

Alternatively, positioning drainage member 5 may include placing drainage member 5 in recess 60 with the first side 10 facing substantially downward. Substantially downward is herein defined to mean that point 15 of first side 10 is vertically lower than the corresponding point 16 on the second side of drainage member 5.

Alternatively, drainage member 5 may be connected to additional drainage members 5 and/or transfer members 31. Referring to FIG. 5, drainage member 5 is connected to a pipe cap 4 and a transfer member 31. Transfer member 31 provides a flow conduit between lower end 6 of drainage member 5 and a predetermined release location.

The method may include fabricating the drainage member 5. The fabricating step may include cutting the appropriate length of the drainage member 5. The fabricating step may include positioning the apertures 16, including determining the shape and size of the apertures 16. The fabricating step may include the combining of more than one drainage member 5. The fabricating step may include combining at least one drainage member 5 with at least one transfer member. The fabricating step may include connecting additional piping components and/or connector components to at least one drainage member. Some or all of the fabricating step may occur away from the installation site or may occur on site.

The installation may require that the drainage member 5 be placed within the recess 60 in intervals wherein some or all of the steps will be repeated at different intervals. For example, the burying step may occur on a section of drainage members 5 and/or transfer members 31 before additional drainage members 5 and/or transfer members 31 are positioned. As a further example, a burying step may occur before additional recesses 60 are prepared. The aforementioned are just a few examples of the disjointedness that may occur in regard to the performance of the method steps as disclosed herein. Persons having ordinary skill in the art will understand that the steps may be performed in any order, and several steps may be performed simultaneously or in series, or the steps may be disjointed in time and place.

The burying step may encompass the total burial of at least part of the drainage member 5 and/or transfer member 31. The burying step may encompass the total burial of the drainage member 5 and/or the transfer member 31.

Figure 6:
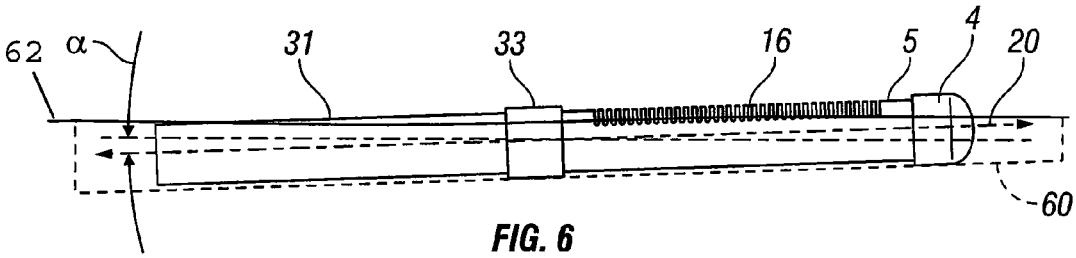
FIG. 6 shows a cross sectional view of a drainage member installed with the bottoms of the apertures substantially at ground level.

Referring to FIG. 6, preparing step prepares the recess 60 for a substantially shallow burial of the drainage member 5 and/or the transfer member 31. The method depicted in FIG. 6 shows the positioning of the drainage member 5, and/or transfer member 21, within the recess 60 such that at least a portion of the drainage member 5, and/or transfer member 31, is protruding above the surface level 62.

The burial step may encompass a method of installation comprising installing a drainage member 5 to function as a partially-above-ground, gravity-fed, collection conduit.

The positioning step may include positioning the drainage member 5 such that the first side 10 is facing substantially upward. The positioning step may further include positioning the drainage member 5 such that the axis 20 is inclined with respect to the horizon as described above.

The burying step may include burying the drainage member 5 so that at least a portion of the apertures 16 are disposed at a vertical level equal to that of the ground surface 62. In other words, the surface level 62 and at least a portion of the uppermost surface of the drainage member 5 substantially lie within the same plane, wherein that plane is substantially equal to the surface level 62.

Alternatively, the burying step may include burying at least a portion of the drainage member 5 such that at least a portion of the apertures 16, namely a portion of the depth 46 of the apertures 16, are disposed above the level of the ground surface 62. The burying step may further include burying the apertures 16 such that the base portions 13 of the apertures 16 are substantially level with the surrounding ground surface 62. Substantially level with the surrounding ground surface 62 is defined herein to allow for a portion of the area directly below the base portions 13 to be situated above the ground surface in an amount that is no greater than depth 46.

The burying step may be defined to bury at least a portion of the drainage member 5 wherein at least two-thirds of the depth 46 of the aperture 16 is above the level of ground surface 62 and not more than an equivalent depth of non-apertured pipe body directly below the bottom 13 of a aperture 16 is above ground surface 62.

Figure 7:
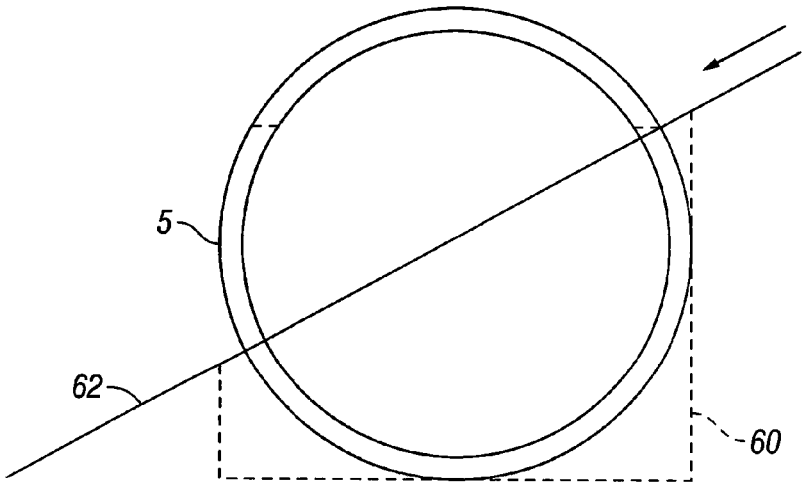
FIG. 7 shows a perspective view of a drainage member installed on an inclined surface partially above the surface of the ground.

Referring to FIG. 7, the preparing step may include preparing a recess 60 in an inclined ground surface 62. The inclined ground surface 62 may be, for example, the side of a hill. The inclined surface need not be as drastic as the side of the hill; however, the inclined surface will be offset from horizontal in relation to the horizon. The recess 60 provided allows the drainage member 5 to be oriented substantially perpendicular to the grade. In other words, drainage component 5 may be oriented substantially perpendicular to the flow of water flowing from a position above the drainage component 5 intermediate the top of the inclined ground surface 62 and the drainage member 5. Substantially perpendicular to the grade is defined herein to mean any position that is not parallel to the grade.

The positioning step may include positioning the draining member 5 such that the draining member 5 is positioned substantially parallel to the grade. The positioning step would then angle the axis 20 of the drainage member 5 with respect to horizon.

The positioning step may include positioning the draining member 5 such that the first side 10 is facing substantially outward in relation to the ground within which it is buried.

Alternatively, the positioning step may position the draining member 5 such that the first side 10 is offset from a purely outward facing orientation. Alternatively, component 5 is slightly rotated about axis 20 so that first side 10 is facing uphill. A line is defined between the lateral internal edges 19 of slits 16. Slightly rotated is herein defined to mean the incline of the defined line with respect to horizontal is at least 5° less than the incline of the ground surface 62 with respect to horizontal.

After installation, a liquid enters the drainage member 5 through apertures 16. The incline of the drainage member 5 causes the liquid to flow through the drainage member 5. The liquid is directed to the desired release location. The liquid may also flow through at least one transfer member 31.

The ordering of the aforementioned steps is arbitrary. For example, the fabricating step may be performed prior to, after, or concurrent with the preparing a recess step. By further example, the inserting step of inserting the insert 80 into the drainage member 5 may be performed prior to, after, or concurrent with the preparing a recess step. This list of examples is in no way exhaustive.

In addition to the aforementioned steps the following steps may be performed either on their own or in any combination. A bedding material may be used to surround at least a portion of the drainage member 5 during installation.

Alternatively, the method of use may contain a protecting step comprising applying a layer of protective material to at least a substantial portion of the apertures 16 so that debris such as, leaves, dirt, gravel, rocks, and the like, will be substantially prevented from entering the drainage system through the apertures 16. The protective material may comprise a filter fabric. The protective material may comprise a mesh, such as a wire or alternative fabric mesh. The mesh or fabric should be of a sufficient weave size to prevent at least some undesirable contaminants, such as leaves, dirt, gravel, rocks, and the like, from entering the interior area 28 while allowing for liquid to flow therethrough. The drainage member 5 may be embedded partially or entirely in gravel, sand, or similar material.

Figure 8:
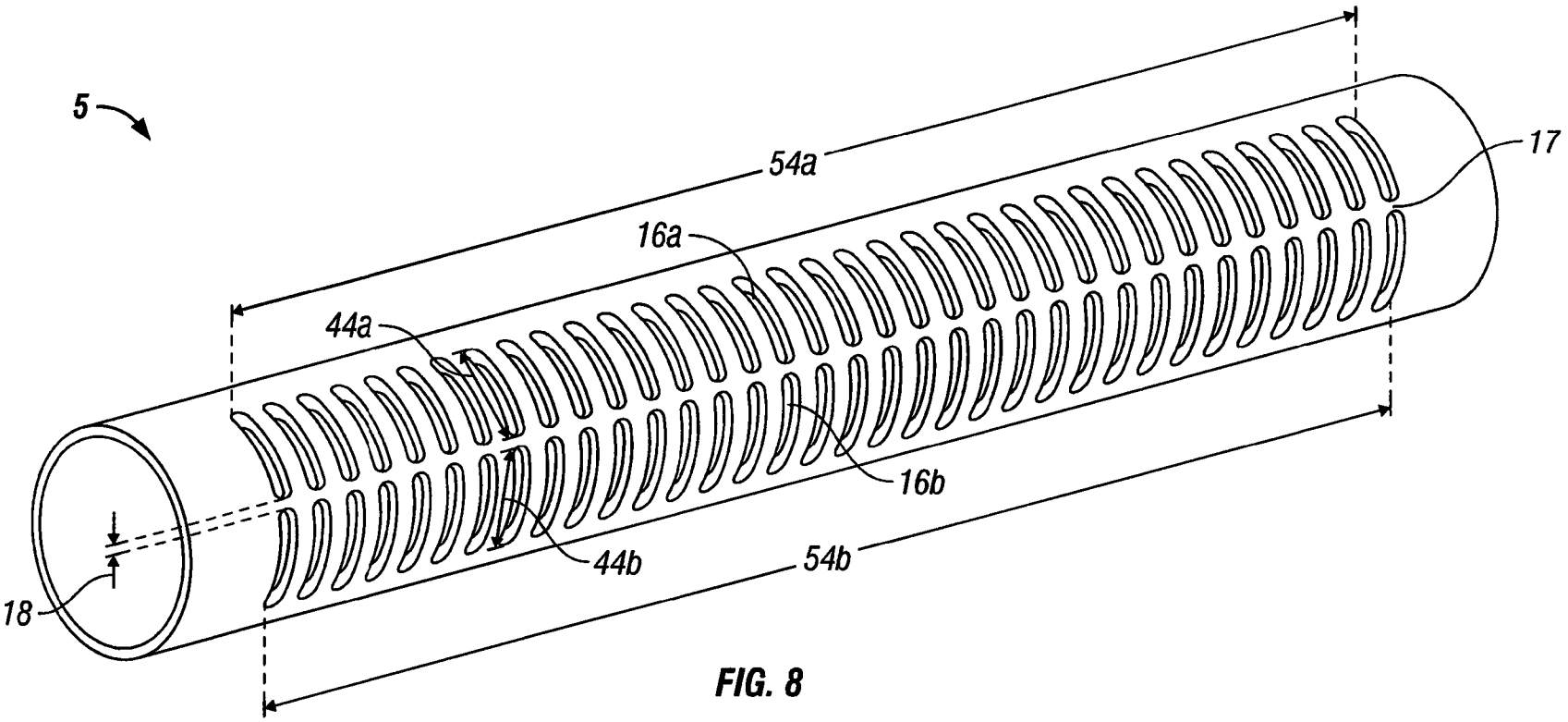
FIG. 8 shows an alternative drainage member having a support rib.

Referring to FIG. 8, an alternate drainage member 5 is shown. At least one support rib 17 bisects the apertures 16 into two parts 16*a* and 16*b*. The parts 16*a* and 16*b* are each comprised of a plurality of corresponding apertures 16 in substantially parallel configurations. As discussed previously, any number of aperture 16 configurations may be utilized such wherein this disclosure is not purely limited to slits as shown in the figures. A purpose of the apertures 16 is to allow fluid flow from the outside of the drainage member 5 to the interior 28 of the drainage member 5. Any aperture 16 that is capable of such liquid transfer is included herein.

The parts 16*a* and 16*b* have corresponding lateral lengths 44*a* and 44*b*. The parts 16*a* and 16*b* have corresponding longitudinal lengths 54*a* and 54*b*. In the exemplary embodiment shown, the support rib 17 extends substantially perpendicular to apertures 16 of parts 16*a* and 16*b*. In the exemplary embodiment shown, the support rib 17 is substantially parallel to the axis 20 of the drainage member 5.

The support rib 17 is intermediate the parts 16*a* and 16*b* of the apertures 16. The support rib has a width 18 that is defined by the distance between the respective adjacent parts 16*a* and 16*b*. In an exemplary embodiment, the width 18 of support rib 17 is at least as wide as the width 40 of apertures 16. A purpose of the support rib 17 is to reinforce or strengthen the drainage member 5.

In an alternative embodiment, more than one support rib 17 may be provided.

In an alternative embodiment, the length 44*a* of the part 16*a* and the length 44*b* of the part 16*b* may not be substantially equal. In an alternative embodiment, the apertures 16 of part 16*a* and the apertures 16 of part 16*b* may not be substantially equal in width 40. In an alternative embodiment the length 54*a* of part 16*a* may not be substantially equal to the length 54*b* of part 16*b*. In yet a further alternative embodiment, there may be more than two parts 16*a* and 16*b*.

In alternative embodiments, a single drainage member 5 can be attached to additional drainage members 5, pipes, and/or pipe fittings to form different configurations.

Figure 9:
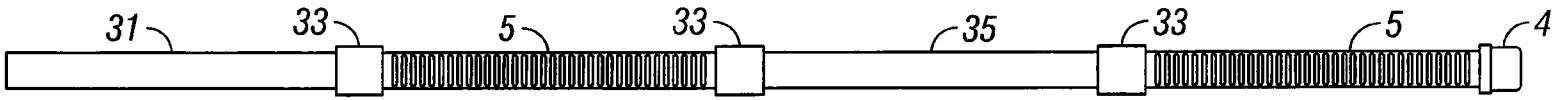
FIG. 9 shows two drainage members installed in series.

Referring to FIG. 9, drainage member 5 may be connected in series with additional drainage members 5 and/or transfer members 31. A cap 4 is connected to a first drainage member 5. First drainage member 5 is connected to a transfer member 31 by a pipe fitting 33. Transfer member 31 is attached to a second drainage member 5 by a second pipe fitting 33. Second drainage member 5 is connected to a second transfer member 31 by a third fitting 33. Alternatively, more than two drainage members 5 may be connected in series. Alternatively, the drainage members 5 can be used and/or connected in parallel configurations, or any combination of series and parallel.

Figure 10:
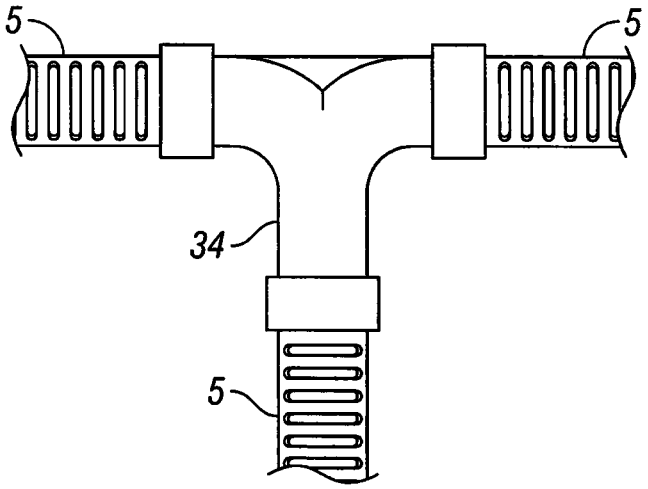
FIG. 10 shows three drainage members connected in a tee configuration.
Figure 11:
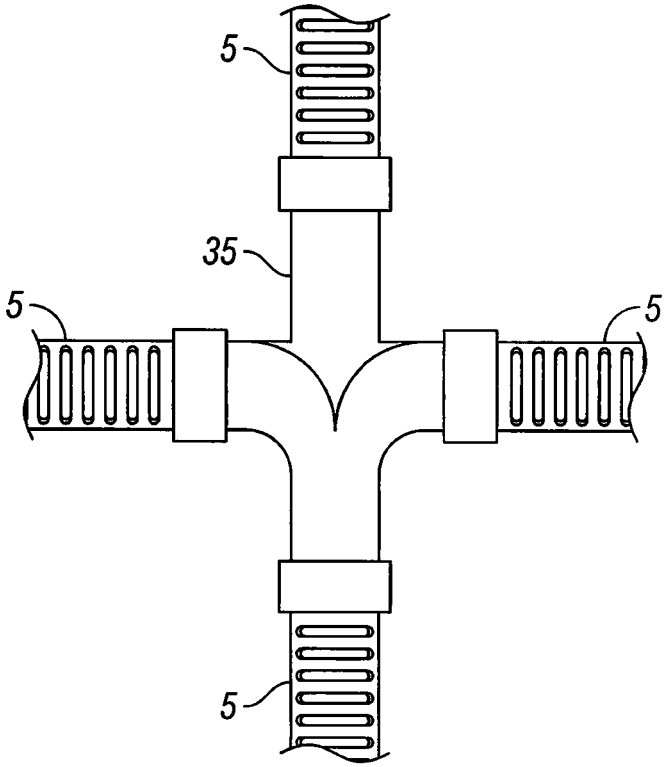
FIG. 11 shows four drainage members connected in a cross configuration.
Figure 12:
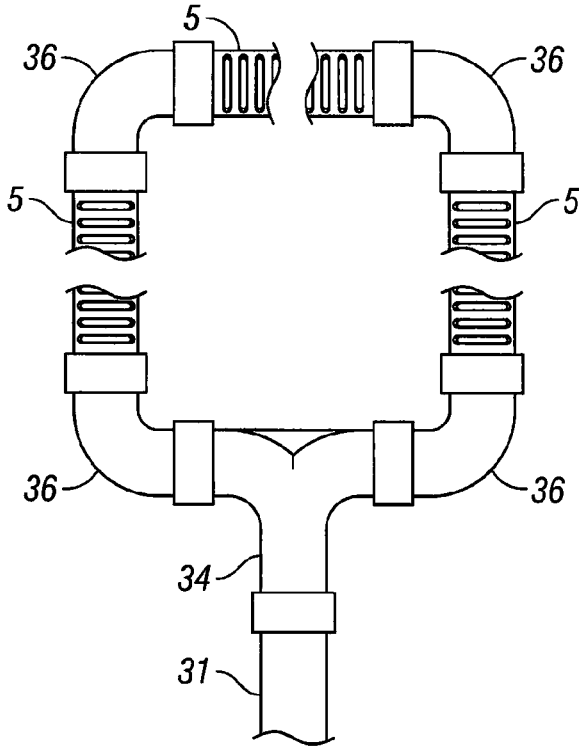
FIG. 12 shows three drainage members connected in a rectangle configuration.
Figure 13:
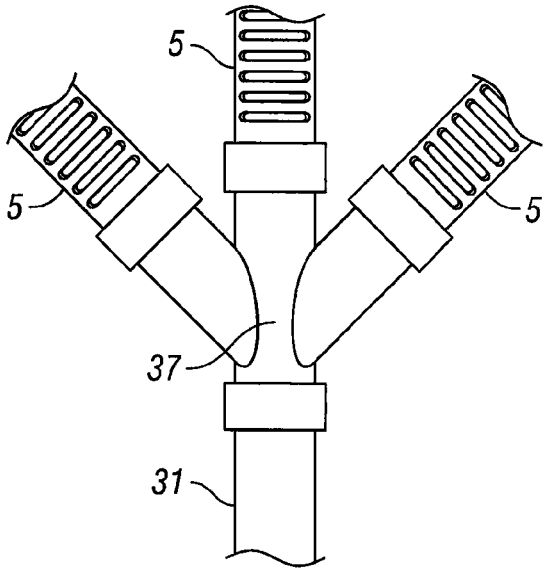
FIG. 13 shows three drainage members connected in a fan configuration.

Referring to FIGS. 10-13, four configurations formed using drainage members 5 are shown. Referring to FIG. 10, three drainage members 5 are connected at a T-fitting 34. Referring to FIG. 11, four drainage members 5 are connected at a four way fitting 35. Referring to FIG. 12, three drainage members 5 are combined using elbow fittings 36 and a T-fitting 34. A rectangular configuration is formed. This configuration may be used as a gravity-fed, collection conduit around the periphery of an object, such as for example a stepping stone. Still referring to FIG. 12, the T-fitting 34 is connected to a transfer member 31. Referring to FIG. 13, three drainage members 5 are connected to a three way fan fitting 37. Fan fitting 37 is connected to a drainage component 31.

Those skilled in the art will understand that several alternative configurations, as well as combinations of the disclosed and non-disclosed alternative configurations, are available for use with the teachings of this disclosure.

Figure 14:
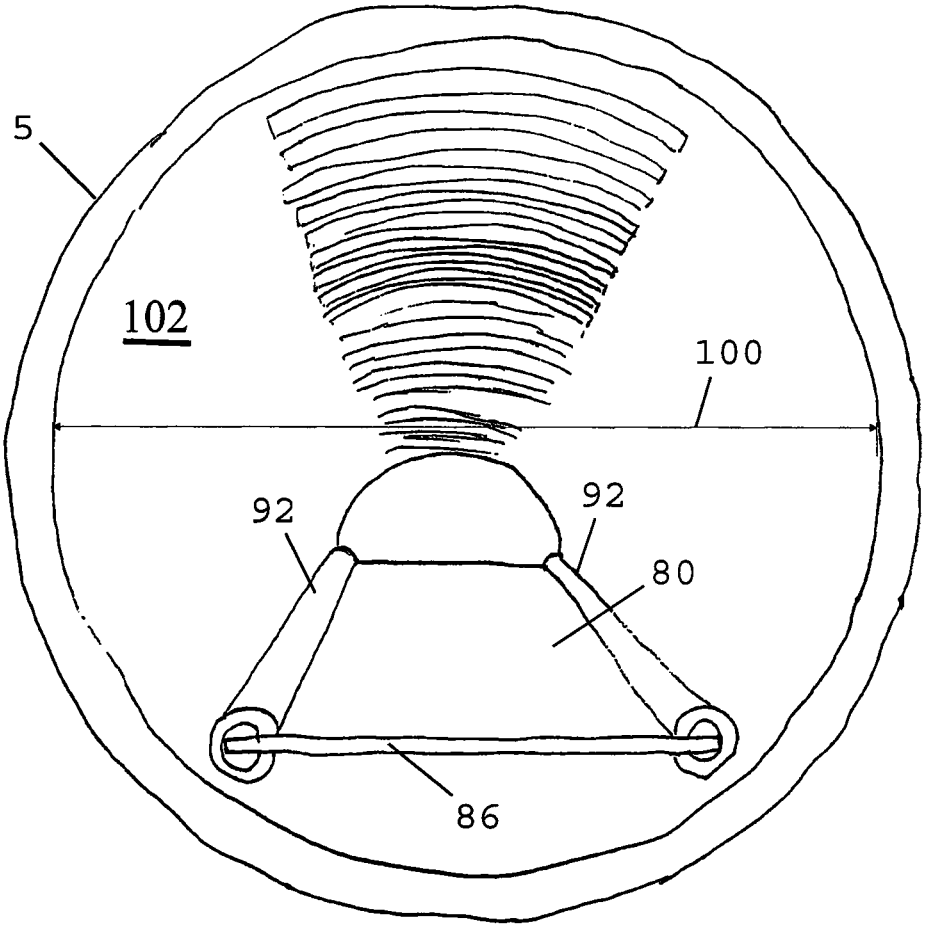
FIG. 14 shows a drainage member having an opposite incline insert plate inserted therein.

Referring to FIG. 14, an insert 80 is shown inserted in drainage member 5. insert 80 may be used in drainage member 5 in order to aid with fluid flow. For example, the insert 80 may be utilized if it is desired for fluid entering drainage member 5 to be conveyed in the direction opposite to the natural conveyance direction of the drainage member 5. Further, if the drainage member 5 is not positioned wherein it is declined in any direction then the insert 80 may be used to convey the fluid in either direction.

Figure 15:
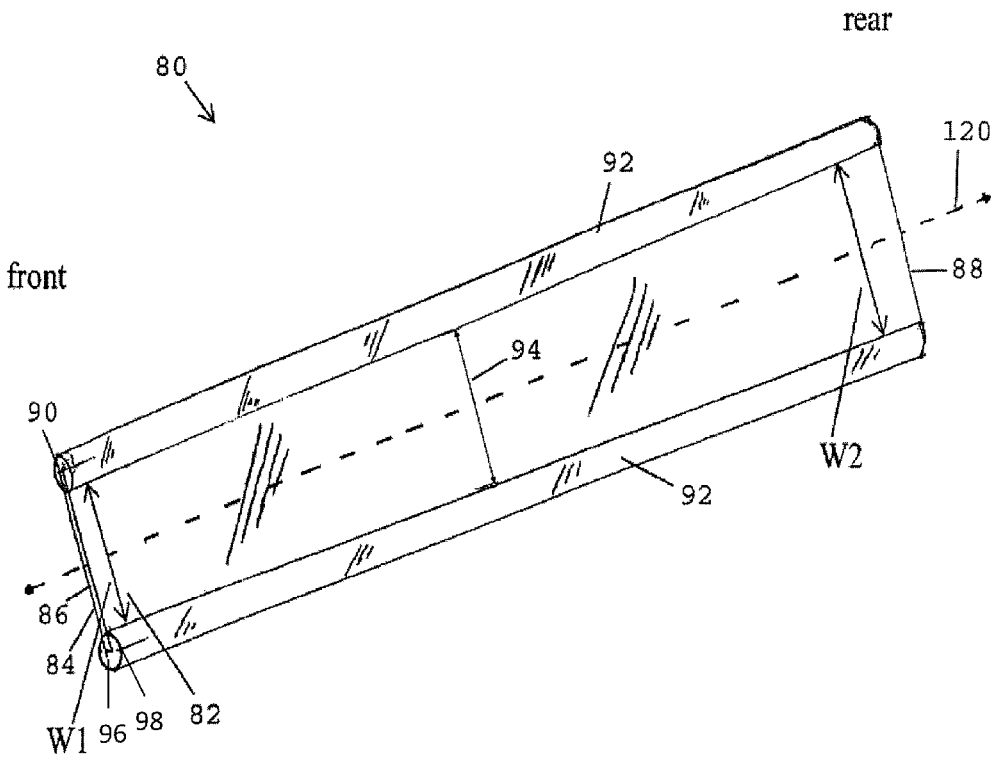
FIG. 15 shows an opposite incline insert plate.

Referring to FIG. 15 insert 80 is shown. Insert 80 comprises a top surface 82, a bottom surface 84, a forward end 86, a rear end 88, and sides 90. Insert 80 has a width 94. Width 94 increases from forward end 86 to rear end 88. The width 94 at forward end 86 is designated as W1 and the width 94 at rear end 88 is designated as W2. A longitudinal axis 120 is shown on insert 80 for descriptive purposes.

A covering 92 may be utilized along the sides 90.

Optionally, the covering 92 may include seals. The seals 92 are generally annular members 96 each have a longitudinal slit therein 98. Sides 90 are each inserted into a slit 98. The seals 92 may be of any configuration. A purpose of the seals 92 is to aid in the positioning of the insert 80 within the drainage member 5. The seals 92 may be ribbed in order to prevent the slippage of the insert 80 or the twisting of the insert 80 due to slippage along one of the sides 90. Any known, or later discovered, manner of preventing slippage may be utilized along the sides 90 to effect the intended purpose herein.

Figure 16:
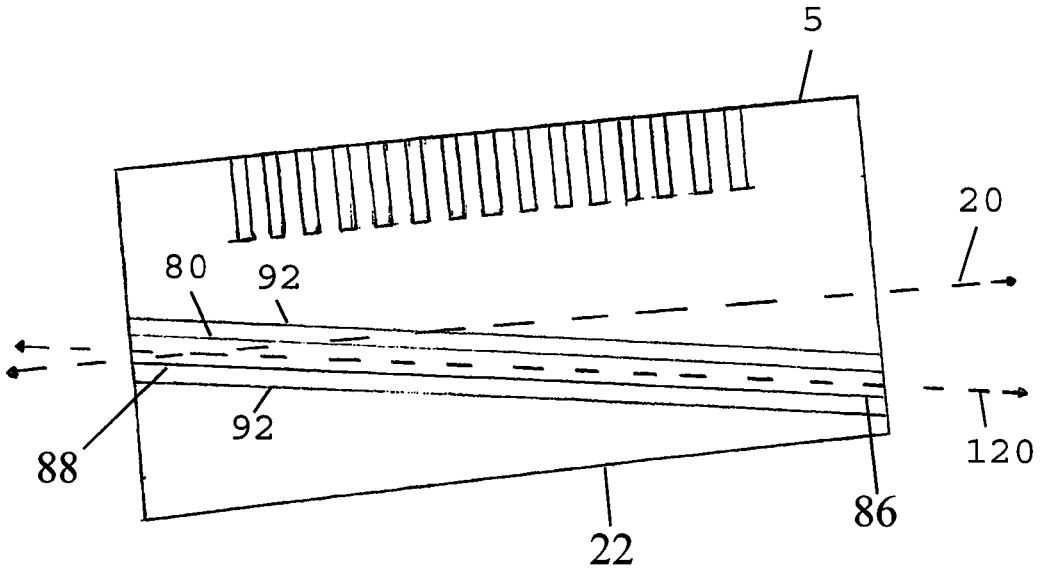
FIG. 16 shows a cross section of a drainage member having an opposite incline insert plate inserted therein.

Referring to FIGS. 14 and 16, drainage member 5 has an internal diameter 100 and an inner surface 102. Width W1 of the forward end is less than the widest portion of the internal diameter 100. Width W2 of the rear end 88 is at least equal to or less than the widest portion of the internal diameter 100 of the drainage member 5.

The longitudinal tapering along the insert 80 allows the forward end 86 to be disposed closer to bottom 22 in relation to the location of the rear end 88 which is disposed at a relatively higher location. This declination of the insert 80 allows for fluid flow through the drainage member 5 from the rear end 88 towards the forward end 86. This fluid flow towards the forward end 86 remains possible even when the drainage member 5 is positioned at a divergent incline in relation to the insert 80 as shown in FIG. 16. FIG. 16 shows a cross sectional view of insert 80 inserted within a drainage member 5. The longitudinal axis 20 of the drainage member 5 is inclined to the left, whereas the longitudinal axis 120 of the insert 80 is inclined to the right.

When used, seals 92 contact inner surface 102 and define a sealed connection 104 between insert 80 and inner surface 102.

While a plate type insert 80 is depicted, it will be understood by those skilled in the art that the insert may take on a number of internal shapes, such as concave, convex, spherical, parallelepiped, cuboidal, vermiform, or any alternative shape that allows for the tapering of the insert 80 such that the forward end 86 is positioned closer to the bottom 22 than the rear end 88. Further the insert 80 may be made of any suitable material now known, or later discovered, such as plastic, plexi-glass, pvc, form or any other suitable material.

The insert 80 may be used with a transfer member 31. The insert 80 may be integral to the drainage member 5.

In a method of use, the fabricating step may include fabricating an appropriate insert 80 for use with a drainage member 5. The fabricating step may include fabricating a drainage member 5 with an integral insert 80. The fabricating step may include fabricating a transfer member 31 with an integral insert 80. The inserting of the insert 80 may occur at or near the recess 60 or may occur away from the recess 60.

An inserting step wherein the insert 80 is inserted into a drainage member 5. An inserting step wherein the insert 80 is inserted into a transfer member 31.

The preparing step may involve the preparation of a recess 60 that is horizontal or offset from horizontal.

The positioning step may result in the longitudinal axis 120 of the insert 80 being positioned at a divergent incline in relation to the longitudinal axis 20 of the drainage member 5. That is, the longitudinal axis 120 of the insert 80 is opposite of the incline of axis 20 of the drainage member 5. The positioning step may result in the longitudinal axis 20 of the drainage member 5 being positioned parallel to, or substantially parallel to, the horizon. Substantially parallel to the horizon in relation to the aforementioned means that the axis 20 of the drainage member 5 is parallel with the horizon or offset from the horizon but not offset more than 45°.

The aforementioned steps in relation to the various embodiments disclosed herein may be performed with the inclusion of the insert 80.

A purpose of the insert 80 is to allow fluid flow against the gradient created by the drainage member 5. A purpose of the insert 80 is to allow gravity induced fluid flow when the drainage member 5 is parallel or substantially parallel in relation to the horizon.

Generally in operation, fluid enters drainage member 5 through apertures 16 and contacts top surface 82 of insert 80. Fluid is substantially prevented from flowing between inner surface 102 and insert 80 by cover 92. The fluid is conveyed along the declining gradient of the insert 80. This conveyance may be in a direction opposite of the direction the fluid would flow if the insert 80 were not inserted in the drainage member 5.

The number, size, and location of apertures 16 may be different than shown and described with respect to the exemplary embodiments above. The width 40, length 44, and/or distance 42 of the apertures 16 need not be constant even on a single drainage member 5.

The length 44*a* and the length 44*b* of the corresponding parts 16*a* and 16*b* need not be constant or consistent even on a single drainage member 5. The length 54*a* of part 16*a* and the length 54*b* of part 16*b* need not be constant or consistent even on a single drainage member.

If, in an alternative embodiment, the apertures 16 are formed by casting out or other method, the length, depth, and/or bottom of the aperture may be defined differently but one having skill in the art will understand the basic relationships and will still be able to change the parameters as required by the application. In alternative embodiments, if the apertures 16 are formed by casting out or other method, the apertures 16 may have walls at the lateral ends that are vertical or any other angle.

In alternative embodiments the apertures 16 in the pipe body can be formed using various methods including but not limited to a CNC (computer numeral control) mill, a Bridgeport mill, and casting out.

If the apertures 16 are formed so that the base portion 13 can no longer be defined as in FIG. 3, the base portion 13 will generally be defined as the lowest point on the drainage member 5, when the component is oriented in a horizontal position, at which liquid exterior of the drainage member 5 can enter the hollow interior 28.

In an alternative method of operation, the drainage member 5 can be installed in a sump or on-grade and will capture the contributing water from any angle. In an alternative method of operation a pump may be used in conjunction with the drainage member 5.

In alternative methods of use the drainage member 5 can also serve other functions including but not limited to a weir function, an orifice function, and a conveyance pipe function.

In an alternative method of operation, the drainage member 5 can be installed perpendicular to the surface of the ground, being entirely buried, partially buried, or completely above the surface.

Although the drainage member 5 is depicted as a generally hollow, annular member, various shapes of the drainage member 5 may be utilized such as, but not limited to, rectangular, vermiform, cuboidal, parallelepiped and the like.

Unless otherwise stated, each feature disclosed may be replaced by alternative features serving the same, equivalent, or similar purpose. Thus, unless expressly stated otherwise, each feature disclosed is one example only of a generic series of equivalent or similar features.

As used herein, "comprise" and "contain" and variations thereof mean including but not limited to.

Throughout the description and claims of this specification, the singular encompasses the plural unless the context otherwise requires. In particular, where the indefinite article is used, the specification is to be understood as contemplating plurality as well as singularity, unless the context requires otherwise.

All of the features disclosed in this specification (including any accompanying claims, abstract and drawings), and/or all of the steps of any method or process so disclosed, may be combined in any combination, except combinations where at least some of such features and/or steps are mutually exclusive.

I claim:

1. A drainage member comprising:

an annular surface including a first side and a second side;

an aperture section comprising a plurality of apertures formed in the first side of the annular surface;

an upper end segment that does not have a plurality of apertures formed therein; and a lower end segment that does not have a plurality of apertures formed therein, wherein:

each aperture extends in a circumferential direction along the annular surface from a first point to a second point, and a length of each aperture from the first point to the second point is at least three times a width of each aperture;

each aperture comprises an upper edge and a lower edge;

the width of each aperture is defined by a distance between the upper edge and the lower edge of each aperture;

a distance between each aperture is defined by a distance between a lower edge of a first aperture and an upper edge of a second aperture, the distance being the same between each aperture of the drainage member;

a length of the upper end segment is defined by an upper end of the drainage member and the upper edge of an immediately adjacent aperture;

a length of the lower end segment is defined by a lower end of the drainage member and the lower edge of an immediately adjacent aperture;

an axial length of the aperture section is a distance that spans all of the plurality of apertures formed in the drainage member from the upper end segment to the lower end segment;

the axial length includes the width of each aperture in the drainage member and the distance between each aperture; and the axial length is less than a sum of four multiplied by an outer diameter of the drainage member.

2. The drainage member of claim 1, wherein the second side is water impermeable.

3. The drainage member of claim 2, wherein the distance between each aperture is no greater than three times the width of each aperture.

4. The drainage member of claim 2, wherein the distance between each aperture is no greater than one and one-half times the width of each aperture.

5. The drainage member of claim 3, wherein:

the drainage member further comprises a longitudinal axis; and the plurality of apertures are slits that are oriented perpendicular to the longitudinal axis.

6. The drainage member of claim 5, wherein:

each aperture further comprises a first lateral internal edge and a second lateral internal edge; and the first point being the first lateral internal edge and the second point being the second lateral internal edge, and the length of each aperture being a distance between the first lateral internal edge and the second lateral internal edge.

7. The drainage member of claim 6, wherein:

a depth of each aperture is defined by a vertical distance between a third point within an opening of each aperture and at least the first point or the second point; and the depth of each aperture is about a quarter of the outer diameter of the drainage member.

8. The drainage member of claim 7, wherein the length of the upper end segment is at least three-fourths of the diameter of the drainage member.

9. The apparatus of claim 8, wherein the length of the lower end segment is at least three-fourths of the diameter of the drainage member.

10. A method of gravity feeding water through the drainage member of claim 1, the method comprising:

a preparing step wherein a recess is prepared;

a positioning step, wherein said drainage member is positioned in said recess; and a burying step, wherein said drainage member is completely buried.

11. A method of gravity feeding water through the drainage member of claim 1, the method comprising:

a preparing step wherein a recess is prepared, said recess having a recess portion and a surface level;

a positioning step, wherein said drainage member is positioned in said recess; and a burying step, wherein said drainage member is at least partially buried, wherein at least a portion of said first side protrudes above said surface level.

12. An apparatus comprising:

a drainage member comprising an annular surface including a first side and a second side;

a plurality of apertures formed in the first side of the annular surface, wherein each aperture extends in a circumferential direction along the annular surface from a first point to a second point, and a length of each aperture from the first point to the second point is at least three times a width of each aperture; and an insert member, wherein:

said insert member is insertable in said drainage member;

the insert member comprises a forward end, a rear end, and sides;

a width of the insert member increases from the forward end to the rear end;

the sides include a covering; and the covering is an annular seal with a slit that fits over the sides.

13. The apparatus of claim 12, wherein:

the drainage member further comprises an internal diameter and an internal surface;

a width of the forward end of the insert member is less than the internal diameter of the drainage member and a width of the rear end of the insert member is equal to or less than the internal diameter of the drainage member; and the difference between the width of the forward end and the width of the rear end is configured such that the forward end is disposed closer to a bottom of the drainage member in relation to a location of the rear end, which is disposed at a relatively higher location in the drainage member.

14. A drainage member, comprising:

a conduit comprising an annular external surface including a first side and a second side, the first side comprising a lateral segment;

an aperture section comprising a plurality of apertures formed in the lateral segment of the external annular surface, wherein each aperture extends in a circumferential direction along the external annular surface from a first point to a second point; and an upper end segment and a lower end segment, the upper end segment and the lower end segment do not have a plurality of apertures formed therein, wherein:

a length of the upper end segment and a length of the lower end segment are at least three-fourths of an outer diameter of the drainage member;

each aperture comprises an upper edge and a lower edge;

a width of each aperture is defined by a distance between the upper edge and the lower edge of each aperture;

a distance between each aperture is defined by a distance between a lower edge of a first aperture and an upper edge of a second aperture, the distance being the same between each aperture of the drainage member;

the length of the upper end segment is defined by an upper end of the drainage member and the upper edge of an immediately adjacent aperture;

the length of the lower end segment is defined by a lower end of the drainage member and the lower edge of an immediately adjacent aperture;

an axial length of the aperture section is a distance that spans all of the plurality of apertures formed in the drainage member from the upper end segment to the lower end segment;

the axial length includes the width of each aperture in the drainage member and the distance between each aperture;

the axial length is less than a sum of four multiplied by the outer diameter of the drainage member;

an open flow area of each aperture of the plurality of apertures is defined as a length of each aperture times a width of each aperture;

a combined open flow area for the aperture section is a sum of the open flow area of each aperture formed in the drainage member; and the combined open flow area for the aperture section exceeds a cross sectional flow area of the drainage member.

15. The drainage member of claim 14, wherein the distance between each aperture is no greater than three times the width of each aperture.

16. The drainage member of claim 14, further comprising an insert member that comprises a forward end and a rear end, wherein a width of the insert member increases from the forward end to the rear end.

17. The drainage member of claim 14, further comprising a rib in the lateral segment that extends longitudinal to the drainage member and splits the plurality of apertures into a first section of apertures and a second section of apertures.

18. The drainage member of claim 17, wherein a width of the rib is at least as wide as the width of the plurality of apertures.

* * * * *